United States Patent [19]

Hoffman et al.

[11] 3,966,083

[45] June 29, 1976

[54] CONTAINERS FOR THE BULK PACKAGING OF ARTICLES

[75] Inventors: Louis S. Hoffman, Morristown; Michael Lutz, Watchung, both of N.J.

[73] Assignee: Dillon-Beck Manufacturing Company, Hillside, N.J.

[22] Filed: Feb. 5, 1975

[21] Appl. No.: 547,103

[52] U.S. Cl. ..... 220/306; 220/334; 220/94 A; 206/806

[51] Int. Cl.[2] ..... B65D 43/10

[58] Field of Search ..... 220/94 R, 94 A, 334, 220/306, 337, 338, 18; 206/806, 380

[56] References Cited

UNITED STATES PATENTS

| | | | |
|---|---|---|---|
| 1,283,832 | 11/1918 | McCarroll | 220/94 A |
| 2,967,611 | 1/1961 | Bolinger | 206/806 |
| 3,025,947 | 3/1962 | Hammer | 220/94 R |
| 3,148,770 | 9/1964 | Cosman | 206/806 |
| 3,334,714 | 8/1967 | Gordon | 220/94 R |

*Primary Examiner*—George E. Lowrance
*Assistant Examiner*—Joseph M. Moy

[57] ABSTRACT

This invention relates to containers adapted for use in the bulk packaging of articles; such as nails, bolts, screws, nuts and the like; which are commonly employed for home repairs and/or improvements. Each container includes a main body and a pivotally attached lid. The main body includes a bottom wall and upstanding peripheral walls defining a compartment for containing the articles therein. A hollow tubular section is part of the container body and has a height substantially equal to the height of the container compartment. At least a segment of the tubular section has an outer surface defining part of the compartment configuration; the remaining part of the compartment configuration being defined by the peripheral walls of the main body. Upper margins of the peripheral walls and the tubular member which define upper boundaries of the compartment are engaged by cooperating surfaces of the lid to completely enclose the article-containing compartment. The lid is shaped so that it does not obstruct the opening through the hollow tubular member. The container can be displayed or stored in a flat condition, or alternatively, it can be hung on a supporting rod of a peg board or similar supporting structure by inserting the rod through the opening in the tubular member.

8 Claims, 5 Drawing Figures

CONTAINERS FOR THE BULK PACKAGING OF ARTICLES

BACKGROUND OF THE INVENTION

1. Field of the Invention

This invention relates to containers, and more specifically to containers adapted for use in the bulk packaging of articles, and which can be either stored or displayed in a flat condition, or hung on a supporting stem or rod which is attached to a peg board or other supporting structure.

2. Description of the Prior Art

Plastic containers adapted for use in the bulk packaging of nails, bolts, screws, nuts, and other similar articles normally employed for home maintenance and/or improvement operations are well known in the prior art. These containers are generally quite compact, and are often stored, or displayed in a flat condition in bins or storage compartments.

Optionally, it may be desired to display or store such containers by hanging them from a supporting rod or stem. In order to be displayed in this latter manner, the container must have an opening through which the supporting stem can be received. Such an opening is commonly included in a flange, or other extension of the container which is completely remote from the container compartment. Such an approach is suggested in U.S. Pat. Nos. 3,437,199 (Jacobson), 3,645,384 (Wind) and 3,746,162 (Bridges). The inclusion of such an external flange through which the opening is provided increases the overall dimensions of the container. It is highly desirable to include a stem supportable section in the container without increasing its overall dimensions so that the container can also be stored in a bin, or similar compartment without taking up any more space than if the stem supportable section were omitted.

Approaches for including a stem supportable section in a container without increasing the overall size of said container are suggested in British Pat. No. 892,834 and French Patent No. 1,551,154. In each of these containers the opening for receiving a supporting stem or rod is in continuous communication with the article-containing compartment thereof. Accordingly, if the container is employed in the bulk packaging of small articles, such as nails, bolts and the like, such articles may fall out of the opening in the event that the container is advertently misoriented. Accordingly stem supportable sections of the type disclosed in the British and French patents are not well suited for use in containers of the type forming the subject matter of this invention.

U.S. Pat. No. 3,348,668, issued to Amatsu et al, discloses a container for storing a magnetic tape reel therein. That container includes a U-shaped slot in the bottom wall so that a plurality of such containers can be vertically aligned on a stand by aligning the U-shaped slots with a guide rod of the stand. The function of this slot is to permit proper alignment of a plurality of containers so that they can be properly supported on an additional extension of the stand. The container construction disclosed in the Amatsu et al patent does not relate, in any manner, to the container constructions of this invention which are adapted to be hung from a supporting stem or rod.

SUMMARY OF THE INVENTION

This invention relates to non-collapsible containers adapted for use in the bulk packaging of articles; such as nails, screws, bolts, nuts and the like; which are usable for home repairs and/or improvements. The term "non-collapsible," as used throughout this application, refers to a container which maintains its preformed configuration during both the normal handling of the container, and during display of the container, whether it be hung on a supporting rod or stacked with other containers in a storage bin or similar compartment. Specifically, the containers of this invention are distinguishable from conventional paper and envelope structures which easily change shape or collapse during the normal handling thereof.

The containers of this invention include a main body and a lid pivotally connected thereto. The main body of each container includes a bottom wall and upstanding peripheral walls defining a three-dimensional compartment for retaining articles therein. The lid is movable between an opened position permitting access to the compartment for removal of the articles, and a closed position completely sealing the compartment to prevent the inadvertent loss of articles therefrom. A hollow tubular section is part of the main body and is disposed substantially normal to the bottom wall thereof. A supporting stem or rod can be disposed through the opening of the tubular section so that the container can be hung for storage and/or display. At least a segment of the tubular section has an outer surface which defines a part of the compartment configuration; the remaining part of the compartment configuration being defined by the peripheral walls of the main body. Upper margins of the peripheral walls and tubular section which define upper boundaries of the container compartment are engaged by cooperating surfaces of the lid when said lid is in its closed position to completely enclose the compartment, and thereby prevent the escape of articles therefrom. In addition, the lid is shaped so that it does not obstruct, or block the opening extending through the hollow tubular section when said lid is in its closed position, whereby a plurality of containers can be hung for display or storage on a single supporting rod or stem.

In a preferred construction of this invention the front wall of the lid includes an outwardly extending extension which can be manually engaged to open the lid for permitting removal of articles from within the container compartment. Preferably, the hollow tubular section is included in a front wall of the main body of the container and includes an outer segment, the outermost extremity of which extends outwardly from said front wall for a distance which is substantially no greater than the distance that the outermost extremity of the lid extension extends from its front wall. Accordingly, the overall dimensions of the container are substantially the same as a similarly constructed container which does not include a hollow tubular section as a part of its construction. In this embodiment the tubular section also includes an inner segment that extends inwardly from the front wall, and the outer surface of this inner segment defines a part of the container configuration. The upper margin of the inner segment of the tubular section and the upper margins of the peripheral walls of the main body are engaged by cooperating surfaces of the lid when said lid is in its closed position to form a completely enclosed compartment for insuring that articles packaged therein will not be inadvertently dispensed therefrom. The lid includes a U-shaped recess at the front thereof so that the lid does not obstruct the opening through the tubular section when the lid is in its closed position. In this manner a passage is provided completely through the containers so that a plurality of containers can be hung on a single supporting rod or stem.

By forming the tubular section so that it includes an outer segment which extends outwardly from the front wall of the main body the reduction of the storage volume of the article-containing compartment is minimized. However, the outermost extremity of the outer segment preferably should not extend beyond the outermost extremity of the lid extension to avoid increasing the overall dimensions of the container. Most preferably the tubular section should be formed so that the outermost extremity of its outer segment is aligned with the outermost extremity of the lid extension. In such a construction the volume of the article-containing compartment is maximized without increasing the overall dimensions of the container.

Preferably, the extension from the front wall of the lid includes two sections, one on each side of the hollow tubular section when the lid is in a closed position. Each of these sections contains a projection extending downwardly therefrom when the lid is in a closed position for frictionally engaging surfaces of the main body to maintain the lid in its closed position when desired. The retentive force maintaining the lid in its closed position is manually defeatable by a user engaging either section of the extension and applying a force for pivoting the lid into an opened position to permit the removal of articles from within the article-containing compartment of the container.

In a second embodiment of this invention the hollow tubular section is disposed completely within the perimeter of the compartment defined by the peripheral walls of the main body, and the lid contains a opening corresponding in shape to the opening through the tubular section. The opening through the lid is aligned with the opening of the tubular section when the lid is in its closed position to provide an open passage completely through the container. Accordingly, a plurality of containers can be hung on a single supporting rod or stem, in the same manner as described above in connection with the first embodiment of this invention.

The second embodiment of this invention is somewhat less preferred than the first embodiment, because, for equivalent sized containers, the actual storage volume of the container compartment is reduced by the inclusion of the tubular section completely within the periphery of the main body.

Other objects and advantages of this invention will become apparent upon reading the detailed description which follows, taken in conjunction with the drawings.

DESCRIPTION OF THE PREFERRED EMBODIMENTS OF THE INVENTION

This invention relates to a non-collapsible container adapted for use in the bulk packaging of articles; such as nails, bolts, screws, nuts and the like; which are commonly employed in home repair and/or improvement applications. The container can be formed of any suitable material which will retain its configuration during handling and/or storage thereof. Preferably, the entire container is formed in a single injection molding operation, and can be formed from any suitable material, such as plastic. In the most preferred construction the container is injection molded from general purpose polystyrene. In the most preferred embodiment of this invention the container is rectangular in plan view, and has a compartment depth which is less than its width and length.

Figure 1:
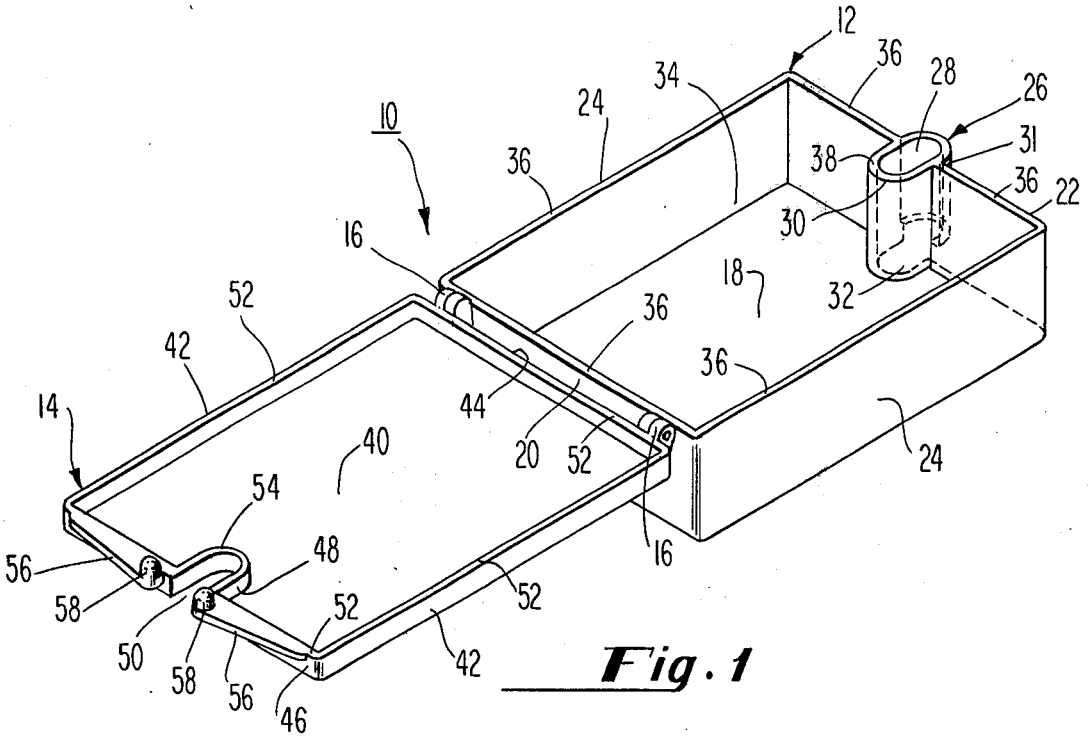
FIG. 1 is an isometric view of an opened container according to this invention.

Referring to FIG. 1, a container 10 includes a main body 12, and a lid 14 pivotally connected to said main body by pivotal connections 16. The pivotal connections 16 preferably are male-female connections injection molded as a single unit along with the main body 12 and lid 14 in the manner disclosed in U.S. Pat. No. 3,456,913, issued to Michael Lutz on July 22, 1969. The subject matter of this patent is incorporated by reference into this application.

The main body 12 of the container 10 includes a bottom wall 18, a rear wall 20, a front wall 22 and side walls 24. A hollow tubular section 26 is disposed substantially normal to the bottom wall 18, and preferably extends for substantially the same height as the peripheral rear, front and side walls. Preferably, the tubular section 26 is formed in the front wall 22 and is disposed midway between the side walls 24. The hollow tubular section 26 has an opening 28 therethrough. The opening 28 can be of any desired configuration, but preferably is oblong in plan view, having its long dimension substantially parallel to the side walls 24 of the main body 12 for a purpose which will be described later in this application. The tubular section 26 includes an inner segment 30 having an outer surface 32, which, along with inner surfaces of the peripheral walls 20, 22 and 24 of the main body 12, define the configuration of a three-dimensional compartment 34 in which articles, such as nails, screws, bolts, nuts and the like can be stored. The upper boundary of the compartment 34 is defined by upper margins 36 of the peripheral walls of the main body 12, and the region of upper margin 38 of the tubular section 26 associated with of the inner segment 30 of said tubular section.

Referring to FIG. 1, the lid 14 includes a top wall 40, peripheral side skirts 42, a peripheral rear skirt 44 and a peripheral front skirt 46. A U-shaped skirt 48 extends inwardly from the front of the lid 14 for defining a U-shaped recess, or opening 50.

Figure 2:
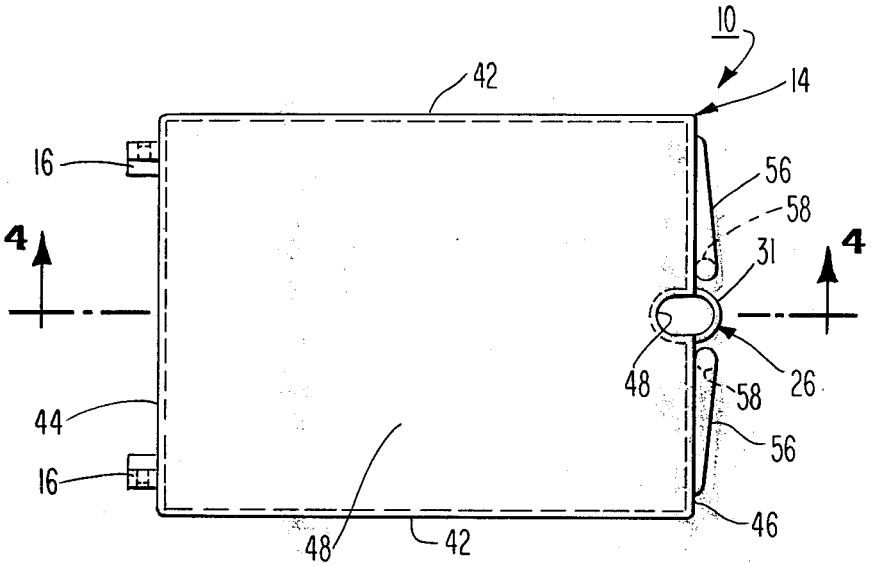
FIG. 2 is a plan view of the container shown in FIG. 1, but with the lid in a closed condition.
Figure 4:
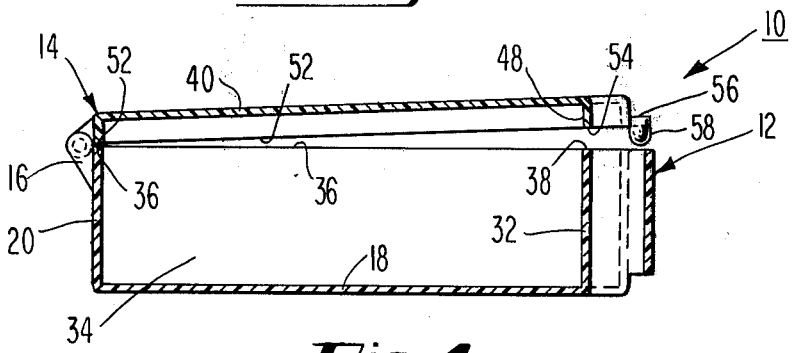
FIG. 4 is a sectional view taken along line 4—4 of FIG. 2 with the lid in a slightly opened condition to show details of construction.

Referring to FIGS. 1, 2 and 4, end margins 52 of the peripheral skirts 42, 44 and 46 of the lid 14 define the same geometric configuration as upper margins 36 of the peripheral walls 20, 22 and 24 of the main body 12 to thereby engage said upper margins 36 when the lid 14 is in a closed position, as suggested in FIGS. 2 and 4. Moreover, an end margin 54 of the U-shaped skirt 48 is complementary in shape to the upper margin 38 of the inner segment 32 of the tubular section 26, and engages said upper margin 38 when the lid 14 is in a closed position. In this manner the end and upper margins of the lid 14 and main body 12, respectively, cooperate to completely close the three-dimensional compartment 34 for retaining articles therein.

Referring to FIGS. 1–4, a pair of peripheral flanges 56 extend outwardly for a slight distance (i.e. ≈ ⅛ inch) beyond the front skirt 46 of the lid 14 on opposite sides of the U-shaped skirt 48. These peripheral flanges 56 provide extensions which can be easily engaged for pivoting the lid 14 to its opened position to permit access into the compartment 34 of the container.

Figure 3:
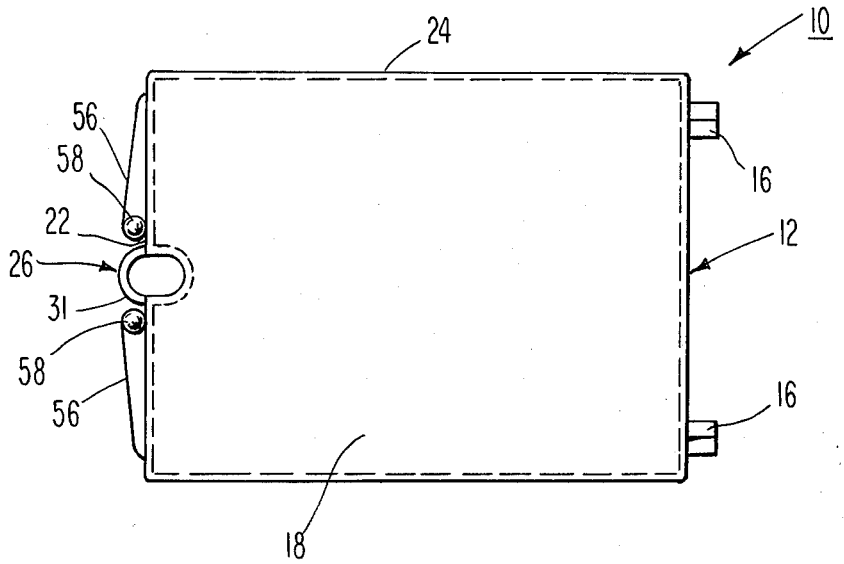
FIG. 3 is a bottom view of the container shown in FIG. 1, but with the lid in a closed condition.

Referring to FIGS. 1 and 3, a projecting nib 58 is associated with each of the flanges 56 closely adjacent the U-shaped skirt 48. These projecting nibs 58 are adapted to frictionally engage the outer surface of the front wall 22 of the main body 12 on opposite sides of, and closely adjacent to an outer segment 31 of the tubular section 26 when the lid 14 is in a closed position (FIG. 3). Accordingly, when the lid 14 is in the closed position, the relationship of the projecting nibs 58 to the outer segment 31 of the tubular section 26 insures that the lid 14 and main body 12 will be properly aligned to provide a completely enclosed three-dimensional compartment 34 for retaining articles therein. The frictional engagement between the nibs 58 and the outer surface of the front wall 22 of the main body 12 maintains the lid in a closed position and yet is manually defeatable by the engagement of the flanges 56 by a user so that easy access to the compartment 34 of the main body 12 can be had.

Referring to FIGS. 2 and 3, the outermost extremity of outer segment 31 of the tubular section 26 extends outwardly from the front wall 22 of the main body 12 for substantially the same distance that the outermost extremity of the peripheral flanges 56 extend from the front skirt 46 of the lid 14. In this manner, the outermost extremities of each of the peripheral flanges 56 lie in substantially the same plane as the outermost extremity of the outer segment 31 of the tubular section 26. Accordingly, the volume of the article-containing compartment 34 is maximized without increasing the overall dimensions of the container 10.

In view of the above disclosure it can be seen that the container 10 of this invention can be mounted on a supporting rod by inserting such a rod (not shown) through the opening 28 of the hollow tubular section 26. In view of the fact that the recess 50 in the front of lid 14 is aligned with the opening 28, a plurality of containers 10 can be mounted on a single, elongate supporting rod. The oblong configuration of the opening 28, as described earlier, permits easy insertion of the container 10 over a supporting rod which has an upturned front end section. Rods having upturned end sections are quite commonly employed to insure that the containers, once inserted onto the rod, cannot inadvertently slide or be knocked off of it.

Figure 5:
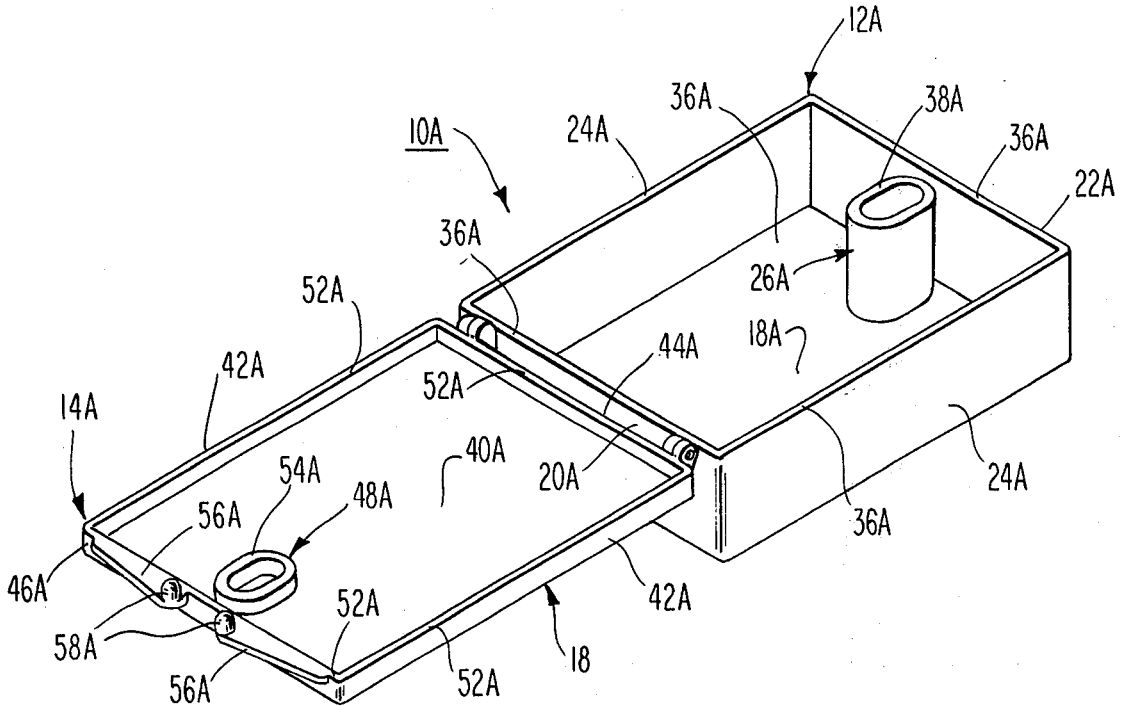
FIG. 5 is an isometric view of an opened container according to a second embodiment of this invention.

Referring to FIG. 5, a second embodiment of a container 10A according to this invention is shown. Elements of this container which are similar to the container 10 will be referred to by the same numerals employed in describing container 10, but with a suffix "A." The container 10A includes a main body 12A which differs from the main body 12 of the container 10 by the specific location of the hollow tubular section. Specifically, the hollow tubular section 26A of the container 10A is disposed completely within the perimeter of the main body 12A. Stating this another way, the tubular section 26A is not integrally formed with any of the upstanding peripheral walls 20A, 22A or 24A. This construction is somewhat less preferred than the construction of container 10 because the effective storage volume of the compartment 34A is less than that of the compartment 34 for comparable sized containers. Preferably, the tubular section 26A extends upwardly from a bottom wall 18A of the main body 12A for substantially the same height as the peripheral walls of said main body and terminates in an upper margin 38A.

A lid 14A includes a hollow tubular hub 48A which extends completely through a top wall 40A of said lid. The tubular hub 48A preferably extends for substantially the same height as peripheral skirts 42A, 44A and 46A of the lid 14A, and is positioned in the lid 14A such that its end margin 54A completely engages upper margin 38A of the tubular section 26A. Accordingly, when the lid 14A is in a closed position, the three-dimensional, article-containing compartment 34A is completely closed by the engagement of peripheral end margins 52A and the end margin 54A of the lid 14A with the upper margins 36A and upper margin 38A of the main body 12A.

The lid 14A includes a peripheral flange 56A extending slightly outwardly from the front peripheral skirt 46A of the lid 14A to provide a surface which can be easily engaged for opening the lid to permit access into the article-containing compartment 34A. This extension 56A can include projecting nibs 58A which cooperate with the outer surface of the front peripheral wall 20A of the main body 12A to frictionally retain the lid in its closed position in a manner similar to that described above in connection with container 10.

Obviously, the cooperative relationship realized between the projecting nibs 58 and the outer segment 31 of the tubular section 26 in the container 10 is not achieved in the container 10A.

Having described our invention, we claim:

1. A non-collapsible container adapted for use in the bulk packaging of articles, such as nails, bolts, screws, nuts and the like, said container being adapted to be stored or displayed in either a flat condition or hung on a supporting rod or stem, said container comprising:

a. a main body including a bottom wall and peripheral side, front and rear walls extending upwardly from the bottom wall to define a three-dimensional compartment providing the greatest article-retaining volume of the container, a hollow tubular section having a passageway therethrough, said tubular section being associated only with the main body of the container and being joined to the front wall thereof, said tubular section being disposed with its passageway substantially normal to the bottom wall and having an inner segment defining a part of the configuration of the three-dimensional compartment and an outer segment disposed exteriorly of said compartment, said peripheral walls and inner segment of the tubular section having upper margins defining the upper boundaries of said three-dimensional compartment;

b. a lid pivotally connected to the rear wall of the main body and movable between a closed position for enclosing the three-dimensional compartment and an opened position for permitting access into said compartment, said lid including a front wall having a recess therein which is aligned with the portion of the passageway extending through the inner segment of the hollow tubular section when the lid is in a closed position so as to provide an unobstructed passageway through the tubular section for permitting a plurality of containers to be hung on a supporting rod by inserting said rod through only the passageway of the tubular section of each container, said lid including marginal surfaces for engaging the upper margins of the peripheral walls and inner segment of the tubular section of the main body when the lid is in a closed position for completely enclosing the three-dimensional compartment.

2. The container according to claim 1, wherein the upper margin of the inner segment of the tubular section is disposed in substantially the same plane as the upper margins of the peripheral walls of the main body.

3. The container according to claim 1, wherein said tubular section is unitarily formed with the front peripheral wall of the main body.

4. The container according to claim 1, including a pair of peripheral flanges extending outwardly for a slight distance from a front skirt of the lid and being disposed on opposite sides of the recess each flange including retention means for frictionally engaging surfaces of the main body of the container when the lid is in a closed position to maintain said lid in its closed position.

5. The container according to claim 4, wherein the outermost extremity of the outer segment of the tubular section is disposed outwardly of a front peripheral wall of the main body for a distance which is substantially no greater than the distance the outermost extremity of each flange extends from the front peripheral skirt of the lid.

6. The container according to claim 5, wherein the outermost extremity of the outer segment of the tubular section and the outermost extremity of each flange lie in substantially the same plane.

7. The container according to claim 1, wherein the passageway through the tubular section is oblong in plan view and has its long dimension substantially parallel to the side peripheral walls of the main body.

8. The container according to claim 1, including manually defeatable frictionally engaging surfaces on said lid and main body for maintaining the lid in its closed position when desired, said lid including a flange extending outwardly beyond the front peripheral wall of the main body whereby said flange can be manually grasped to open the lid for permitting removal of articles from within the three-dimensional compartment of the main body.

* * * * *